US006354876B1

(12) United States Patent
Yu

(10) Patent No.: US 6,354,876 B1
(45) Date of Patent: Mar. 12, 2002

(54) ELECTRONIC CARD CONNECTOR HAVING IMPROVED GROUNDING PLATE

(75) Inventor: Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/738,693

(22) Filed: Dec. 15, 2000

(30) Foreign Application Priority Data

Oct. 31, 2000 (TW) ..... 89218876 U

(51) Int. Cl.[7] ..... H01R 13/648
(52) U.S. Cl. ..... 439/607; 439/92; 439/159
(58) Field of Search ..... 439/607–610, 439/92, 95, 101, 159, 160, 108

(56) References Cited

U.S. PATENT DOCUMENTS 5,967,813 A * 10/1999 Ho et al. ..... 439/159
6,162,070 A * 12/2000 Yu et al. ..... 439/108
6,227,879 B1 * 5/2001 Dong ..... 439/159
6,238,240 B1 * 5/2001 Yu ..... 439/607

* cited by examiner

*Primary Examiner*—Hien Vu
(74) *Attorney, Agent, or Firm*—Wei Te Chung

(57) ABSTRACT

An IC card connector comprises a dielectric housing (10), a number of terminals (20), a conductive grounding plate (40), and a metal shield (30) with an actuating rod (50). The housing has a cross bar (13) with a mating surface (11) against which an inserted IC card abuts. The terminals have mounting ends (22) protruding forwardly from the cross bar. The grounding plate includes a base (45), a flange (42) for securing the grounding plate on the housing, a pair of bridges (41) abutting against the mating surface, and a number of soldering fingers (44) projecting rearwardly from the mating surface. The soldering fingers and the mounting ends are soldered to a printed circuit board at rear and front sides of the cross bar, respectively, thereby facilitating inspection and re-soldering of the mounting ends.

11 Claims, 5 Drawing Sheets

ELECTRONIC CARD CONNECTOR HAVING IMPROVED GROUNDING PLATE

BACKGROUND OF THE INVENTION

1. Field of the Invention

The present invention relates to an electronic card connector, and particularly to an electronic card connector with an improved grounding plate to facilitate soldering of terminals of the electronic card connector to a printed circuit board.

2. Brief Description of the Prior Art

Referring to FIG. 5, a conventional IC card connector 8 mounted on a printed circuit board 83 comprises a dielectric housing 801 having a mating surface 802 against which an inserted IC card abuts, a plurality of terminals 81 for electrically connecting with the inserted IC card, and a grounding plate 80 for dissipating electrostatic charges on the IC card. The grounding plate 80 has L-shaped soldering tails 82 extending onto the printed circuit board 83. The terminals 81 are soldered to the printed circuit board 83 at positions between the housing 801 and the soldering tails 82. Since the terminals 81 are nested in the grounding plate 80, the soldering portions of the terminals 81 are hidden by the soldering tails 82. Accordingly, after the grounding plate 80 has been mounted to the housing 801, it is difficult to inspect and re-solder the soldering portions of the terminals 81.

Hence, an improved IC card connector is desired to overcome the disadvantages of the prior art.

BRIEF SUMMARY OF THE INVENTION

An object of the present invention is to provide an IC card connector with a grounding plate which facilitates inspection and re-soldering terminals thereof after the grounding plate has been secured to a printed circuit board To achieve the above-mentioned object, an IC card connector in accordance with a first embodiment of the present invention includes a dielectric housing with a plurality of terminals, a metal shield covering the housing and having an actuating rod for actuating an IC card, and a metal grounding plate located between the shield and the housing.

The housing provides a space for receiving the IC card. The housing further provides a cross bar which defines a mating surface against which the IC card is inserted, and a front surface opposite the mating surface. The terminals are integrally molded within the cross bar. Mounting ends of the terminals protrude beyond the front surface of the cross bar.

The grounding plate includes a base extending into the space, a pair of bridges depending from a front edge of the base and abutting against the mating surface of the cross bar, an opening defined between the bridges and the base and encompassing the terminals, and a plurality of soldering fingers bending perpendicularly and rearwardly from a lower edge of each bridge. The base forms a flange extending from a front edge thereof into a depression defined in the crossbar, for securing the grounding plate on the cross bar.

A second embodiment is essentially similar to the first embodiment. However, a grounding plate includes a base secured on the cross bar, a pair of bridges extending from the base over a front surface anda lower surface of the cross bar, and a plurality of soldering fingers projecting rearwardly from the bridges beyond the mating surface.

Similarly, in a third embodiment, a grounding plate forms a plurality of soldering fingers stamped upwardly from a base of the grounding plate. The soldering fingers are positioned at a rear side of the mating surface.

In the three embodiments, the mounting ends of the terminals and the soldering fingers of the grounding plate are positioned at front and rear sides of the cross bar, respectively. Soldering portions of the mounting ends are thus substantially distanced from those of the soldering fingers. Accordingly, after the grounding plate has been mounted to the housing, inspection and re-soldering of the mounting ends is facilitated.

Other objects, advantages and novel features of the present invention will become more apparent from the following detailed description of the present embodiment when taken in conjunction with the accompanying drawings.

DETAILED DESCRIPTION OF THE INVENTION

Figure 1:
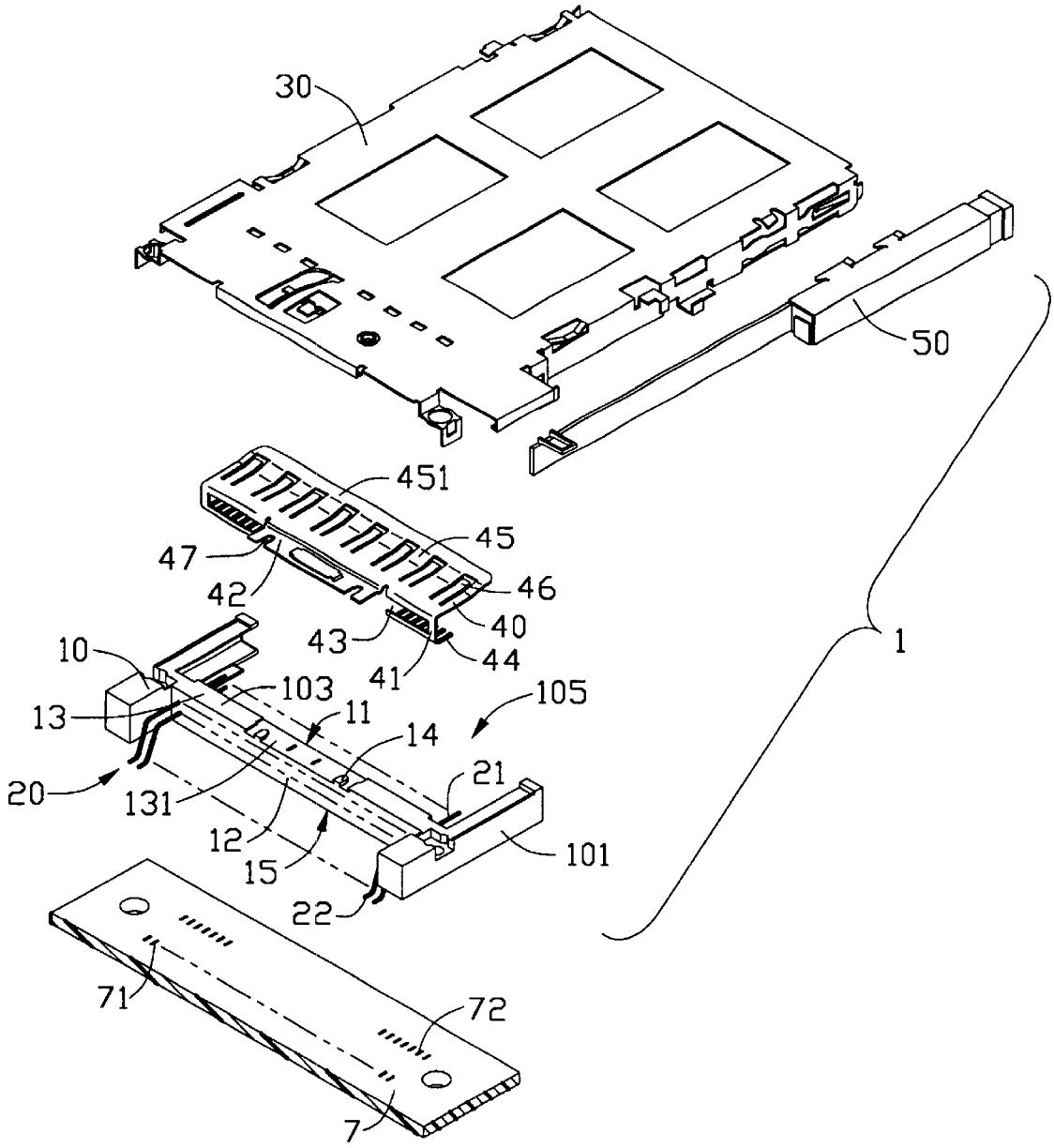
FIG. 1 is an exploded view of an IC card connector in accordance with a first embodiment of the present invention, also showing a part of a printed circuit board.
Figure 2:
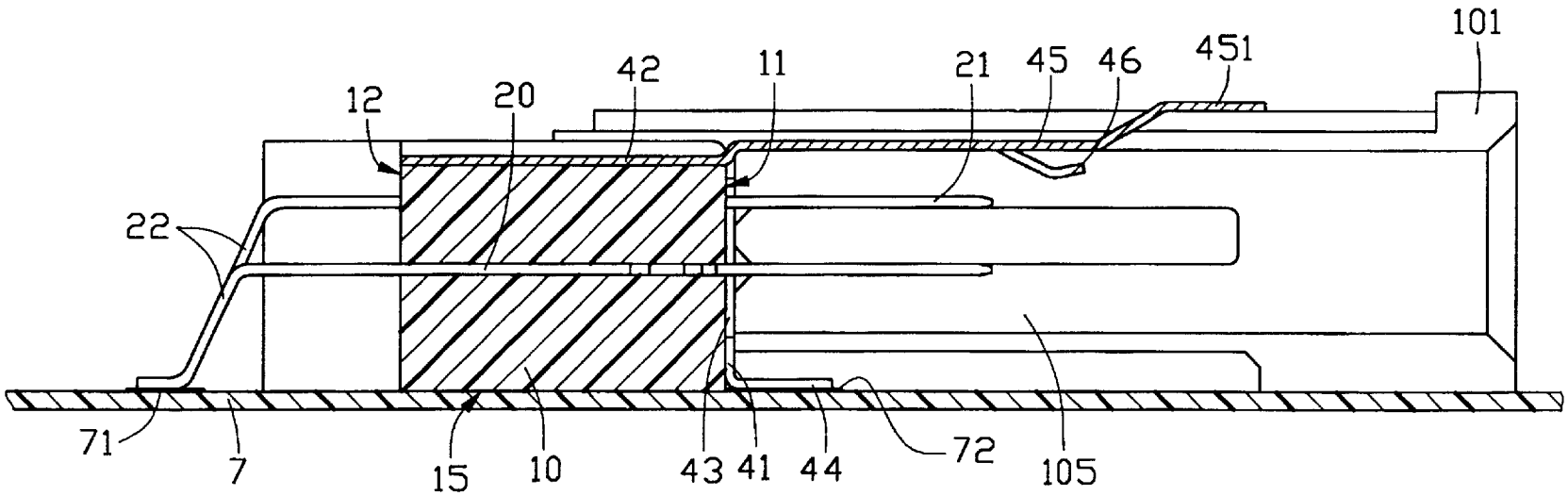
FIG. 2 is a cross-sectional assembled view of the IC card connector of FIG. 1 mounted on the printed circuit board of FIG. 1, with a shield of FIG. 1 omitted for clarity.

Referring to FIGS. 1 and 2, an IC card connector 1 in accordance with a first embodiment of the present invention comprises a dielectric housing 10, a plurality of terminals 20 insert molded within the housing 10, a conductive grounding plate 40, a metal shield 30, and an actuating rod 50.

The housing 10 is H-shaped and includes a pair of arms 101, a cross bar 13 connecting the arms 101, and a space 105 for receiving an IC card (not shown). The cross bar 13 has a mating surface 11 at a rear side thereof, a front surface 12 opposite the mating surface 11, an upper surface 103, and a lower surface 15 opposite the upper surface 13. The upper surface 13 defines a depression 131, within which is deposited a pair of embossed protrusions 14.

Each terminal 20 has an engaging end 21 protruding from the mating surface 11 of the housing 10, and a mounting end 22 protruding from the front surface 12 of the housing 10. The engaging ends 21 are adapted for engaging with pins of the IC card (not shown). The mounting ends 22 are for soldering to a printed circuit board 7, by surface mounting technology (SMT).

The grounding plate 40 is formed from a metal sheet. The grounding plate 40 comprises a base 45, a pair of L-shaped bridges 41 depending from lateral sides of the base 45, an opening 43 defined between the base 45 and the bridges 41, and a plurality of soldering fingers 44 extending perpendicularly and rearwardly from a lower edge of each bridge 41. The base 45 has a free end 451 angularly extending from a rear edge of the base 45, a plurality of tongues 46 stamped downwardly from the base 45, and a flange 42 extending forwardly from a front edge of the base 45 between the bridges 41. The flange 42 defines a pair of cutouts 47 in a front edge thereof.

In assembly, the grounding plate 40 is secured on the cross bar 13 of the housing 10. The actuating rod 50 is mounted to the shield 30, and the shield 30 together with the actuating rod 50 is then mounted onto the housing 10 for shielding the terminals 20. The actuating rod 50 cooperates with means (not shown) on the shield 30 to function as ejecting means for ejecting an inserted IC card (not shown). As the structure of the ejecting means is well known by those skilled in the art of card connectors such as PCMCIA card connectors and Card Bus connectors, a detailed description of the ejecting means is omitted herein. Finally, the assembled IC card connector 1 is mounted onto the printed circuit board 7. The printed circuit board 7 forms a plurality of first soldering pads 72 located at a rear side of the mating surface 11 of the cross bar 13 and connected to grounding traces of the printed circuit board 7, and a plurality of second soldering pads 71 located at a front side of the cross bar 13.

The grounding plate 40 is secured on the housing 10 by means of the flange 42 being inserted into the depression 131 and the cutouts 47 being engaged with the protrusions 14. The base 45 projects over the space 105 with the free end 451 extending more than half-way over the space 105 for guiding insertion of an IC card (not shown) and contacting the shield 30 thereabove. The tongues 46 are suspended in the space 105 for electrically engaging with grounding pads on a shell of the inserted IC card, to dissipate electrostatic charges on the IC card. The bridges 41 abut against the mating surface 11 and the engaging ends 21 of the terminals 20 are then encompassed by the opening 43. The soldering fingers 44 extend beneath the space 105 and are essentially flush with the lower surface 15 of the housing 10, for being soldered onto the first soldering pads 72.

The mounting ends 22 of the terminals 20 and the soldering fingers 44 of the grounding plate 40 are soldered onto the second soldering pads 71 and the first soldering pads 72 of the printed circuit board 7, respectively. As is best shown in FIG. 2, soldering positions of the soldering fingers 44 of the grounding plate 40 and soldering positions of the mounting ends 22 of the terminals 20 are distributed at respective opposite sides of the mating surface 11. Therefore, a distance between the soldering position of the mounting ends 22 and the soldering position of the soldering fingers 44 is large enough to easily solder the mounting ends 22 and the grounding fingers 44 to the corresponding soldering pads 71, 72, respectively. In addition, the mounting ends 22 of the terminals 20 are no hidden by the soldering fingers 44. This facilitates inspection and re-soldering of the mounting ends 22 to the soldering pads 71.

Figure 3:
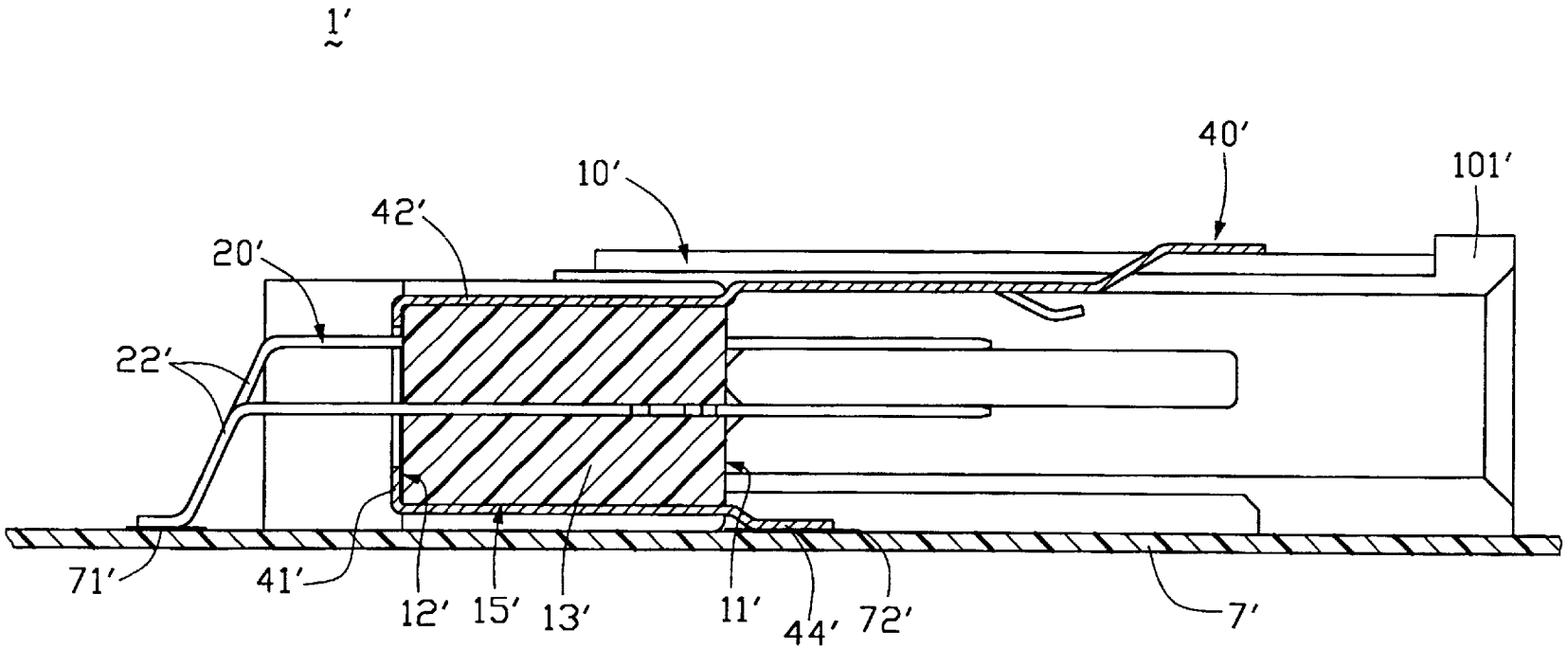
FIG. 3 is a view similar to FIG. 2, showing an IC card connector in accordance with a second embodiment of the present invention mounted on a printed circuit board.

FIG. 3 illustrates a second embodiment of the present invention, in which, for simplicity, similar numerals stand for similar elements of both the first and second embodiments. An IC card connector 1' comprises a dielectric housing 10', a plurality of terminals 20', and a conductive grounding plate 40'. The housing 10' includes a pair of arms 101' and a cross bar 13' connecting the arms 101'. The cross bar 13' defines a mating surface 11' against which an IC card (not shown) abuts, and a lower surface 15' spaced from a printed circuit board 7' on which the IC card connector 1' is mounted. The grounding plate 40' includes a flange 42' which engages with an upper side of the cross bar 13' for securing the grounding plate 40' on the cross bar 13', a pair of L-shaped bridges 41' extending over a front surface 12' and the lower surface 15' of the cross bar 13', and a plurality of soldering fingers 44' extending from the bridges 41' and projecting rearwardly from the mating surface 11'. The printed circuit board 7' has a plurality of first and second soldering pads 72', 71'. The first soldering pads 72' are connected to grounding traces of the printed circuit board 7'.

As is clearly shown in FIG. 3, the soldering fingers 44' are soldered to the first soldering pads 72' positioned at a rear side of the cross bar 13', while mounting ends 22' of the terminals 20' are soldered to the second soldering pads 71' positioned at a front side of the cross bar 13'.

Figure 4:
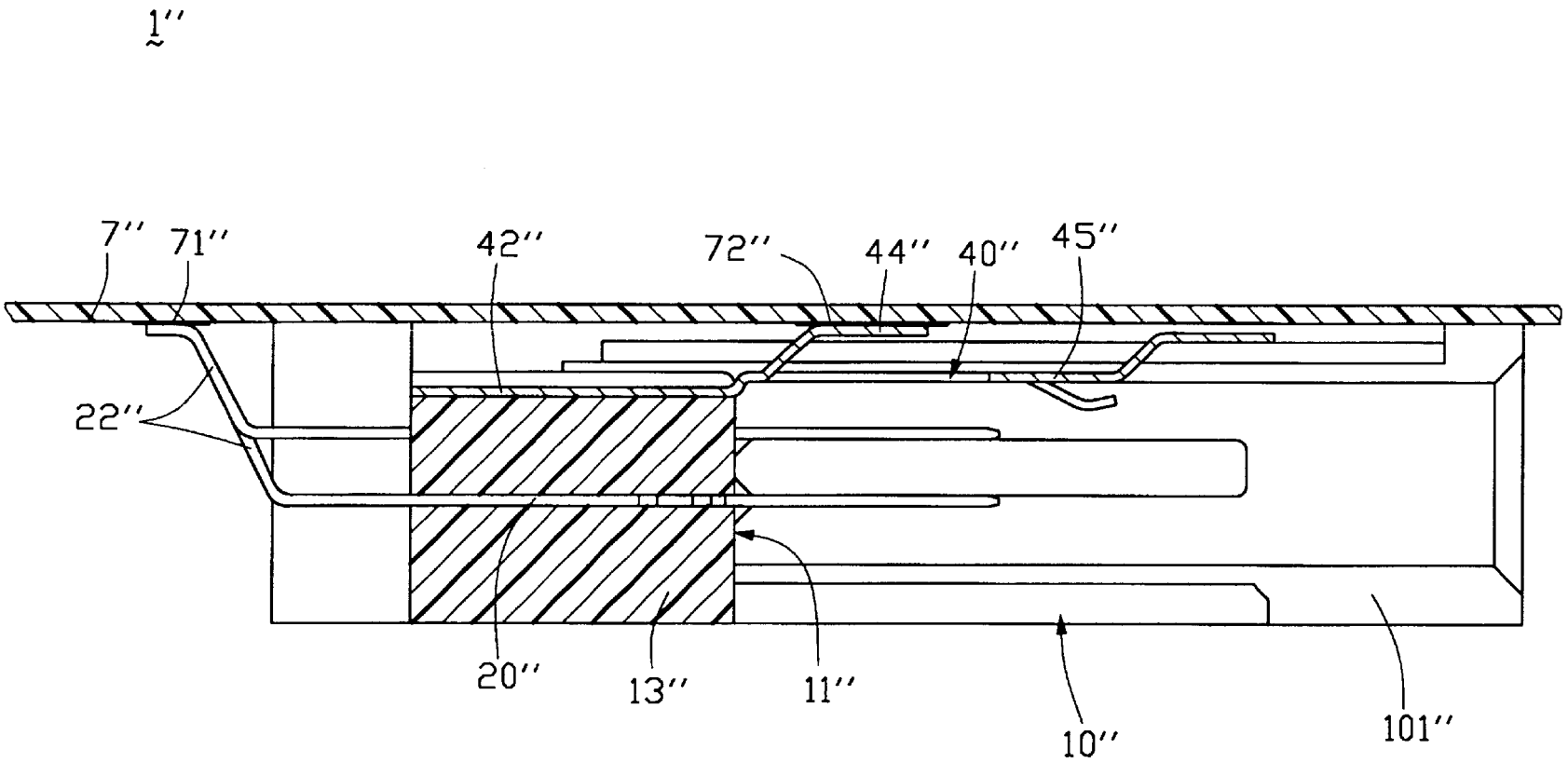
FIG. 4 is a view similar to FIG. 2, showing an IC card connector in accordance with a third embodiment of the present invention mounted on a printed circuit board.
Figure 5:
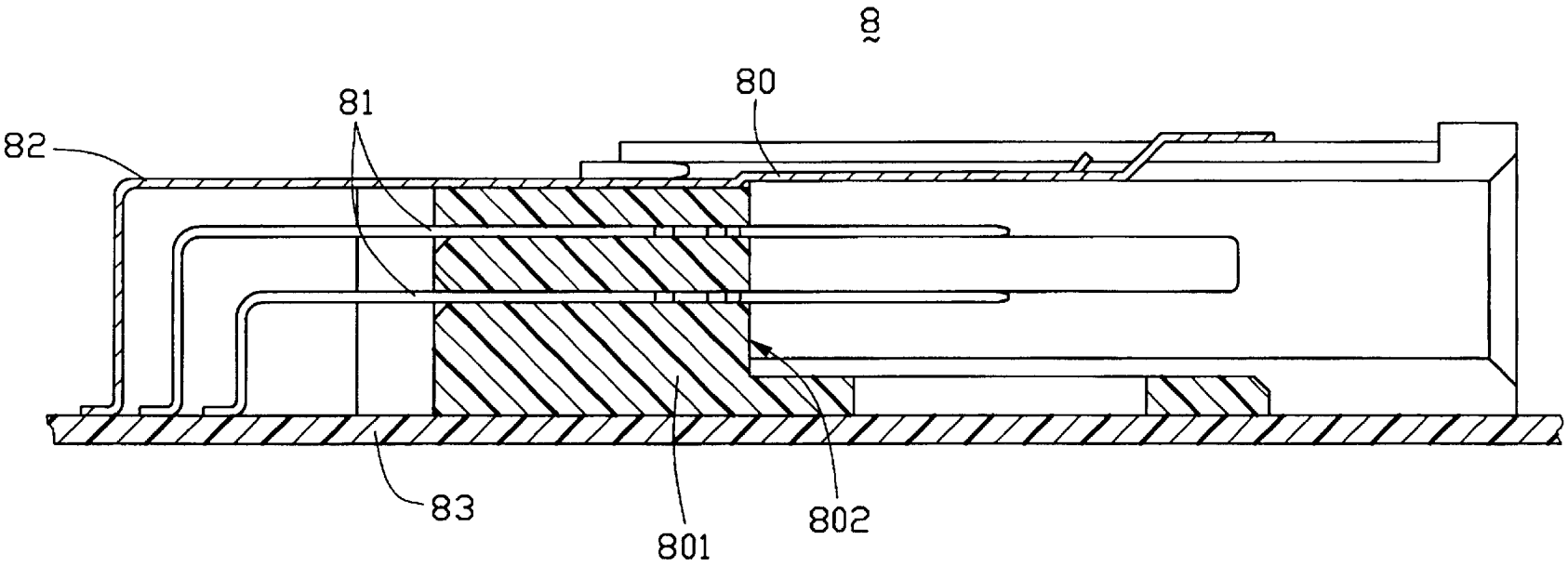
FIG. 5 (PRIOR ART)
FIG. 5 is a view similar to FIG. 2, showing a conventional IC card connector mounted on a printed circuit board.

FIG. 4 illustrates a third embodiment of the present invention, whereby an IC card connector 1" is adapted for attachment beneath a printed circuit board 7". Similar numerals stand for similar elements of both the first and third embodiments. The IC card connector 1" comprises a dielectric housing 10", a plurality of terminals 20" integrally molded with the housing 10", and a metallic grounding plate 40". The housing 10" has a cross bar 13" connecting a pair of arms 101", and has a mating surface 11" against which an IC card (not shown) is inserted. The cross bar 13" is upper relative to the printed circuit board 7" than the arms 101", thereby providing space for the grounding plate 40". The grounding plate 40" is substantially planar and includes a base 45" and a plurality of soldering fingers 44" stamped upwardly from the base 45". The base 45" forms a flange 42" extending forwardly therefrom for securing the grounding plate 40" on the cross bar 13". The soldering fingers 44" are soldered to first soldering pads 72" on the printed circuit board 7" positioned at a rear side of the mating surface 11", while mounting ends 22" of the terminals 20" are soldered to second soldering pads 71" on the printed circuit board 7" positioned at a front side of the mating surface 11".

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An IC card connector for mounting on a printed circuit board, comprising:

an insulative housing including a space for accommodating an IC card and a cross bar, the cross bar having a mating surface against which the IC card abuts and a front surface opposite the mating surface;

a plurality of conductive terminals secured in the cross bar, each of terminals including an engaging end protruding into the space from the mating surface for mating with the IC card, and a mounting end extending from the front surface for being soldered on the printed circuit board; and a conductive grounding plate secured on the cross bar and having at least one soldering finger for being soldered on the printed circuit board;

wherein each soldering finger is soldered at a position wherein the distance between each soldering finger and the mating surface is less than the distance between the mounting ends of the terminals and the mating surface; wherein the at least one soldering finger and the mounting ends of the terminals are soldered at respective different sides of the cross bar; wherein the grounding plate has at least one bridge abutting against the mating surface of the cross bar, and the at least one soldering finger extends from the bridge toward the space; wherein the grounding plate further includes a base extending over, the space and a plurality of tongues protruding from the base into the space for engaging with the IC card.

2. The IC card connector as claimed in claim 1, wherein the at least one soldering finger is soldered at a position within the space, and the mounting ends are soldered at a position outside the space.

3. The IC card connector as claimed in claim 1, wherein the grounding plate includes a flange engaging with the cross bar for securing the grounding plate on the cross bar.

4. The IC card connector as claimed in claim 1, wherein the grounding plate defines an opening, through which the engaging ends of the terminals extend.

5. The IC card connector as claimed in claim 1, wherein the at least one bridge extends over the front surface and a lower surface of the cross bar, and the at least one soldering finger extends from the bridge into the space for being soldered on the printed circuit board.

6. The IC card connector as claimed in claim 5, wherein the grounding plate defines an opening, through which the terminals extend.

7. The IC card connector as claimed in claim 1, wherein the grounding plate is substantially planar.

8. The IC card connector as claimed in claim 7, wherein the grounding plate includes a base with a flange secured in the cross bar, and a plurality of soldering fingers extending from the base.

9. The IC card connector as claimed in claim 8, wherein the soldering fingers extend in a direction from the mating surface toward the space.

10. An IC card connector assembly comprising:

an IC connector including:

an insulative housing defining a space for accommodating an IC card, and a cross bar having mating surface for mating with the IC card and a front surface opposite to said mating surface;

a plurality of conductive terminals retained in said cross bar and extending out of the front surface with mounting ends thereof for soldering;

a conductive grounding plate including a base positioned on the cross bar, and at least one soldering finger; and a printed circuit board to which the IC connector is mounted; wherein both mounting ends of the terminals and said at least one solder finger are surface mounted to said printed circuit board while respectively by two sides of said cross bar; wherein a metal shield is attached to the housing and cooperates with the housing to sandwich the base of the grounding plate therebetween in a mechanical and electrical contact relationship; wherein said base of the grounding plate includes at least one bridge abutting against the mating surface of the crossbar and a free end being in contact with the shield and providing guidance function of insertion of the IC card.

11. The assembly as claimed in claim 10, wherein said base of the grounding plate, and said printed circuit board are located on the same side of said housing.

* * * * *